US008274463B2

(12) United States Patent
Chang et al.

(10) Patent No.: US 8,274,463 B2
(45) Date of Patent: Sep. 25, 2012

(54) TRANSFLECTIVE LIQUID CRYSTAL DISPLAY

(75) Inventors: Hung-Chang Chang, Taichung County (TW); Po-Sheng Shih, Hsinchu (TW); Sweehan J. H. Yang, Tainan (TW)

(73) Assignee: Hannstar Display Corporation, New Taipei (TW)

( * ) Notice: Subject to any disclaimer, the term of this patent is extended or adjusted under 35 U.S.C. 154(b) by 305 days.

(21) Appl. No.: 12/606,188

(22) Filed: Oct. 27, 2009

(65) Prior Publication Data

US 2010/0321364 A1 Dec. 23, 2010

(30) Foreign Application Priority Data

Jun. 19, 2009 (TW) ..... 98120722 A

(51) Int. Cl.
*G09G 3/36* (2006.01)

(52) U.S. Cl. ..... 345/92

(58) Field of Classification Search ..... 345/92
See application file for complete search history.

(56) References Cited

U.S. PATENT DOCUMENTS

| | | | | |
|---|---|---|---|---|
| 7,808,466 | B2 * | 10/2010 | Morimoto et al. | 345/87 |
| 7,868,976 | B2 * | 1/2011 | Lin et al. | 349/114 |
| 2004/0125090 | A1 * | 7/2004 | Hudson | 345/204 |
| 2006/0284811 | A1 * | 12/2006 | Huang | 345/92 |
| 2010/0309399 | A1 * | 12/2010 | Yang et al. | 349/37 |

* cited by examiner

*Primary Examiner* — Chanh Nguyen
*Assistant Examiner* — Roy Rabindranath
(74) *Attorney, Agent, or Firm* — Jianq Chyun IP Office

(57) ABSTRACT

A transflective liquid crystal display (TR LCD) including a display panel, a first reference voltage line and a second reference voltage line is disclosed. The display panel includes: a plurality of scan lines; a plurality of data lines, disposed substantially perpendicularly to the scan lines; a plurality of pixels arranged in an array, respectively coupled to a corresponding data line and a corresponding scan line. Each pixel has a transparent area and a reflection area, and each row of pixels is divided by definition into a first pixel-group and a second pixel-group. The above-mentioned first reference voltage line and second reference voltage line are respectively coupled to the reflection areas of the pixels of the first pixel-group and the second pixel-group of each row of pixels for respectively receiving a first reference voltage signal and a second reference voltage signal, wherein both the reference voltage signals are time-varying or periodic.

21 Claims, 7 Drawing Sheets

700

TRANSFLECTIVE LIQUID CRYSTAL DISPLAY

CROSS-REFERENCE TO RELATED APPLICATION

This application claims the priority benefit of Taiwan application serial no. 98120722, filed on Jun. 19, 2009. The entirety of the above-mentioned patent application is hereby incorporated by reference herein and made a part of specification.

BACKGROUND OF THE INVENTION

1. Field of the Invention

The present invention generally relates to a flat display, and more particularly, to a transflective liquid crystal display (TR LCD) with single cell gap mode.

2. Description of Related Art

An LCD can be roughly categorized into three types: transmissive type, reflective type and transflective type, wherein the TR LCD able to work by using both a backlight source and an external light source is preferably used in portable electronic products such as mobile phone, personal digital assistant (PDA) and e-book and so on. Based on this advantage, the TR LCD is paid attention to by the relevant manufactures.

In general, a TR LCD can be further categorized into a TR LCD with single cell gap mode and a TR LCD with dual cell gap mode. Since the TR LCD with single cell gap mode is advantageous in simpler fabrication than the TR LCD with dual cell gap mode and lower production cost, so that the TR LCD with single cell gap mode is the most preferable one used in various portable electronic products.

FIG. 1 is an equivalent circuit diagram of a single pixel 101 in a conventional TR LCD 100 with single cell gap mode and FIG. 2 is a graph diagram showing a characteristic curve TC of transmittance vs. pixel voltage (or termed as 'transmissive Gamma curve') of the transparent area TA and a characteristic curve RC of transmittance vs. pixel voltage (or termed as 'reflective Gamma curve') of the reflection area RA within the pixel 101 of FIG. 1. Referring to FIGS. 1 and 2, the pixel 101 has a transparent area TA and a reflection area RA, wherein the transparent area TA has a pixel transistor T, a first liquid crystal capacitor $C_{LC1}$ and a storage capacitor $C_{ST}$ disposed wherein, while the reflection area RA has a coupling capacitor $C_C$ and a second liquid crystal capacitor $C_{LC2}$.

The gate of the pixel transistor T is coupled to a scan line 103 and the source of the pixel transistor T is coupled to a data line 105. The drain of the pixel transistor T is coupled to the first terminals of the first liquid crystal capacitor $C_{LC1}$, the storage capacitor $C_{ST}$ and the coupling capacitor $C_C$. The second terminals of the first liquid crystal capacitor $C_{LC1}$ and the storage capacitor $C_{ST}$ are coupled to a common electrode CE to receive a common voltage Vcom. The second terminal of the coupling capacitor $C_C$ is coupled to the first terminal of the second liquid crystal capacitor $C_{LC2}$ and the second terminal of the second liquid crystal capacitor $C_{LC2}$ is coupled to the common electrode CE.

The conventional transflective display with single cell gap mode provides the reflection area RA with a divided voltage of the coupling capacitor $C_C$ and the provided divided voltage serves as the required pixel voltage. However, it can be seen from FIG. 2 that due to the mismatch between the characteristic curve TC of the transparent area TA and the characteristic curve RC of the reflection area RA of the pixel 101, so that the transmissive displaying effect and the reflective displaying effect of a conventional TR LCD 100 with single cell gap mode are unable to simultaneously achieve the optimization.

In order to make the transmissive displaying effect and the reflective displaying effect of the TR LCD 100 with single cell gap mode simultaneously achieve the optimization, a better solution was provided by the inventor of the present invention in U.S. patent application Ser. No. 12/571,446, which all disclosures are incorporated herein by reference herewith, referring to FIGS. 3 and 4. FIG. 3 is an equivalent circuit diagram of a single pixel 301 in another conventional TR LCD 300 with single cell gap mode and FIG. 4 is a graph diagram showing a characteristic curve TC of transmittance vs. pixel voltage of the transparent area TA and a characteristic curve RC of transmittance vs. pixel voltage of the reflection area RA within the pixel 301 of FIG. 3. In FIGS. 3 and 4, the pixel 301 has a transparent area TA and a reflection area RA, wherein the transparent area TA has a pixel transistor T, a first liquid crystal capacitor $C_{LC1}$ and a storage capacitor $C_{ST}$, while the reflection area RA has a coupling capacitor $C_C$, a second liquid crystal capacitor $C_{LC2}$ and a compensation capacitor $C_{C2}$.

The gate of the pixel transistor T is coupled to a scan line 303 and the source of the pixel transistor T is coupled to a data line 305. The drain of the pixel transistor T is coupled to the first terminals of the first liquid crystal capacitor $C_{LC1}$, the storage capacitor $C_{ST}$ and the coupling capacitor $C_C$. The second terminals of the first liquid crystal capacitor $C_{LC1}$ and the storage capacitor $C_{ST}$ are coupled to a common electrode CE to receive a common voltage Vcom1. The second terminal of the coupling capacitor $C_C$ is coupled to the first terminal of the second liquid crystal capacitor $C_{LC2}$ and the second terminal of the second liquid crystal capacitor $C_{LC2}$ is coupled to the common electrode CE. The first terminal of the compensation capacitor $C_{C2}$ is coupled to the second terminal of the second terminal of the coupling capacitor $C_C$ and the second terminal of the compensation capacitor $C_{C2}$ is coupled to a reference voltage line 307 so as to receive a reference voltage signal Vref with time-varying signal property.

It can be seen from FIG. 4 that the newly added compensation capacitor $C_{C2}$ disposed in the reflection area RA of the pixel 301 and coupled to the reference voltage signal Vref is helpful for the inter-match between the characteristic curve TC of the transparent area TA and the characteristic curve RC of the reflection area RA of the pixel 301, and thereby, the transmissive displaying effect and the reflective displaying effect of the TR LCD 300 with single cell gap mode are able to simultaneously achieve the optimization.

However, the second terminals of all the compensation capacitors $C_{C2}$ respectively in the reflection area RA of each pixel of the TR LCD 300 with single cell gap mode are coupled to the reference voltage line 307 to receive the reference voltage signal Vref, so that the TR LCD 300 with single cell gap mode is limited to adopt the row inversion panel-driving approach and the frame inversion panel-driving approach and forbidden from adopting the column inversion panel-driving approach and the dot inversion panel-driving approach, which brings a disadvantage of lower general purpose of design with the TR LCD 300 with single cell gap mode.

SUMMARY OF THE INVENTION

Accordingly, the present invention is directed to a TR LCD with single cell gap mode having considerably-high general purpose of design and able to adopt the row inversion panel-driving approach, the frame inversion panel-driving approach, the column inversion panel-driving approach and the dot inversion panel-driving approach according to the application need.

The present invention provides a TR LCD, which includes a display panel, a first reference voltage line and a second reference voltage line. The display panel herein includes: a plurality of scan lines; a plurality of data lines, disposed substantially perpendicularly to the scan lines; a plurality of pixels arranged in an array, respectively coupled to a corresponding data line and a corresponding scan line. Each pixel has a transparent area and a reflection area, and each row of pixels is divided by definition into a first pixel-group and a second pixel-group. The above-mentioned first reference voltage line and second reference voltage line are respectively coupled to the reflection areas of the pixels of the first pixel-group and the second pixel-group of each row of pixels for respectively receiving a first reference voltage signal and a second reference voltage signal, wherein both the reference voltage signals are time-varying or periodic.

Based on the depiction above, the TR LCD provided by the present invention makes the reflection areas of all the pixels of the i-th row of pixels (i is a positive integer) of the display panel respectively coupled to different reference voltage lines so as to receive corresponding reference voltage signals. In this way, the TR LCD provided by the present invention not only simultaneously achieves the optimizations of the transmissive displaying effect and the reflective displaying effect, but also is able to adopt the row inversion panel-driving approach, the frame inversion panel-driving approach, the column inversion panel-driving approach, the dot inversion panel-driving approach, the two-lines two-dots inversion panel-driving approach, the two-lines inversion panel-driving approach or the two-rows inversion panel-driving approach according to the application need so as to promote the general purpose of design.

It should be noted that the details of the above-mentioned depiction and the structures hereinafter provided in the embodiments are several preferred embodiments of the present invention only, which does not limit the claim range of the present invention.

DESCRIPTION OF THE EMBODIMENTS

Figure 1:
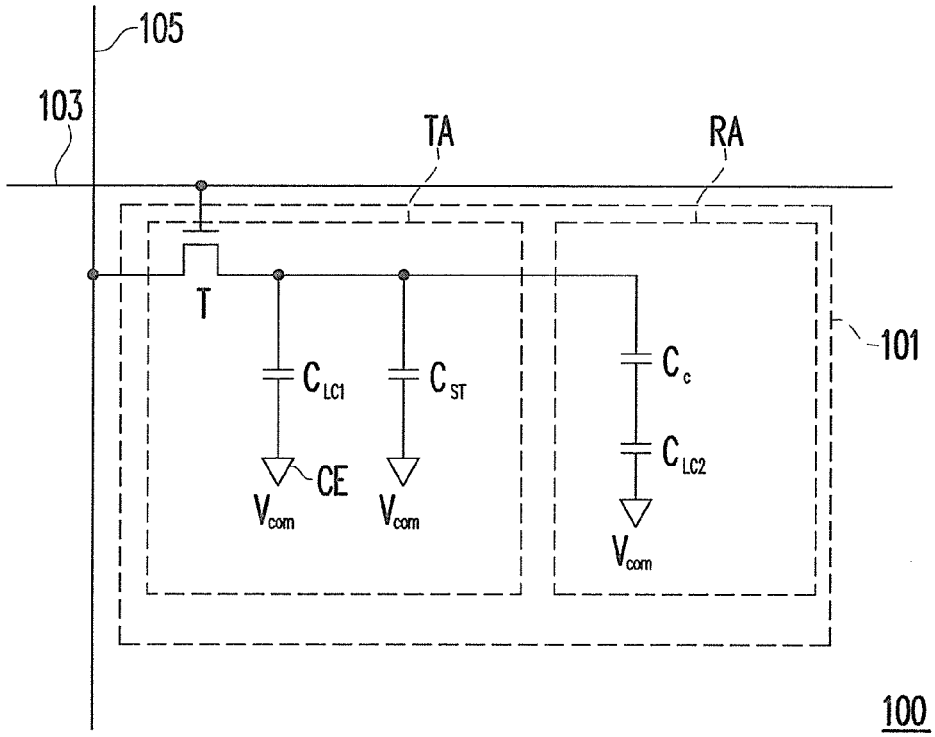
FIG. 1 (RELATED ART)
FIG. 1 is an equivalent circuit diagram of a single pixel in a conventional TR LCD with single cell gap mode.
Figure 2:
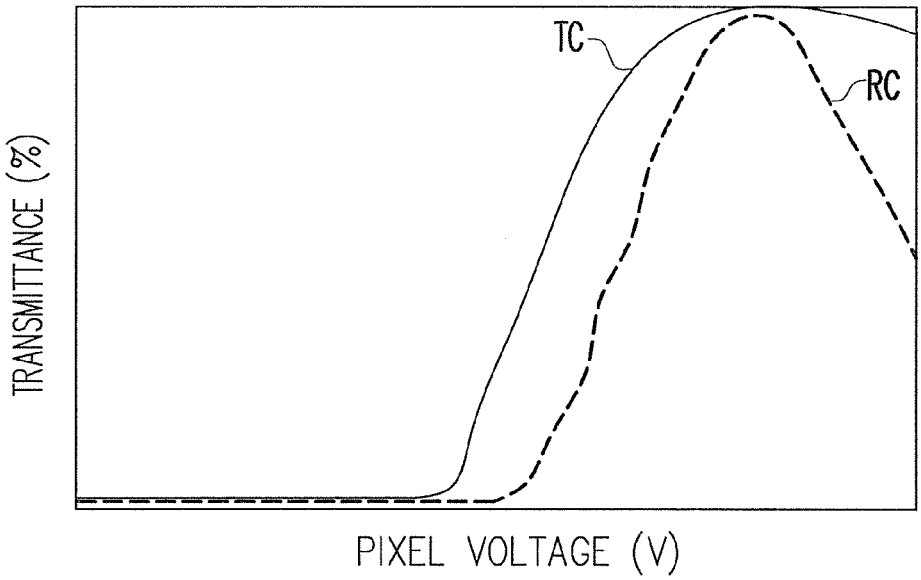
FIG. 2 (RELATED ART)
FIG. 2 is a graph diagram showing a transmissive Gamma curve of the transparent area and a reflective Gamma curve of the reflection area within the pixel of FIG. 1.
Figure 3:
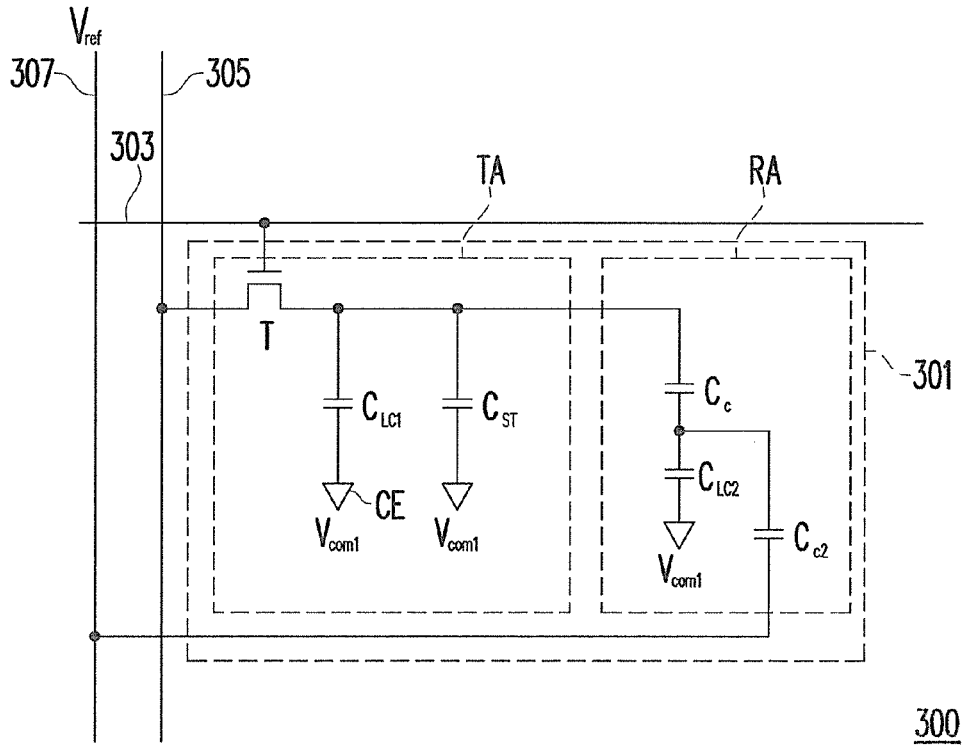
FIG. 3 (RELATED ART)
FIG. 3 is an equivalent circuit diagram of a single pixel in another conventional TR LCD with single cell gap mode.
Figure 4:
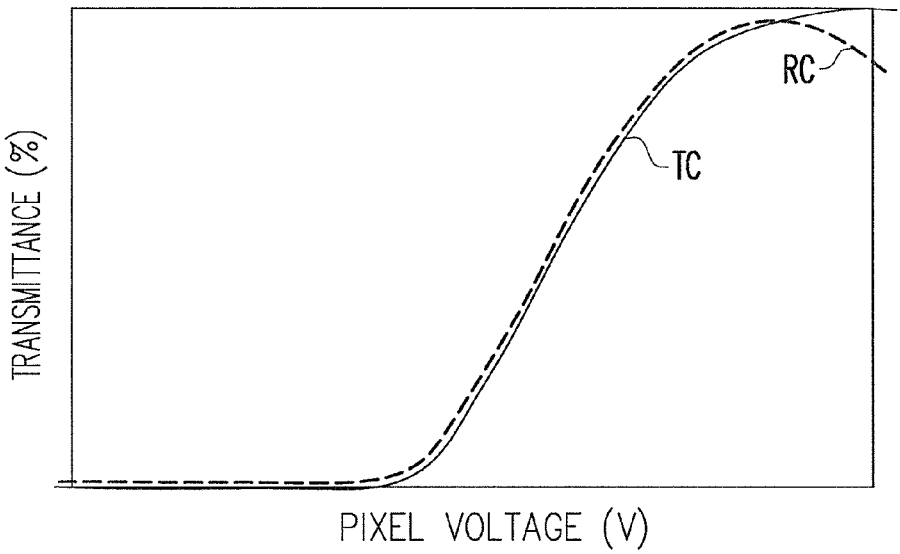
FIG. 4 (RELATED ART)
FIG. 4 is a graph diagram showing a transmissive Gamma curve of the transparent area and a reflective Gamma curve of the reflection area within the pixel of FIG. 3.

Reference will now be made in detail to the present preferred embodiments of the invention, examples of which are illustrated in the accompanying drawings. Wherever possible, the same reference numbers of components/parts are used in the drawings and the description to refer to the same or like parts.

Figure 5:
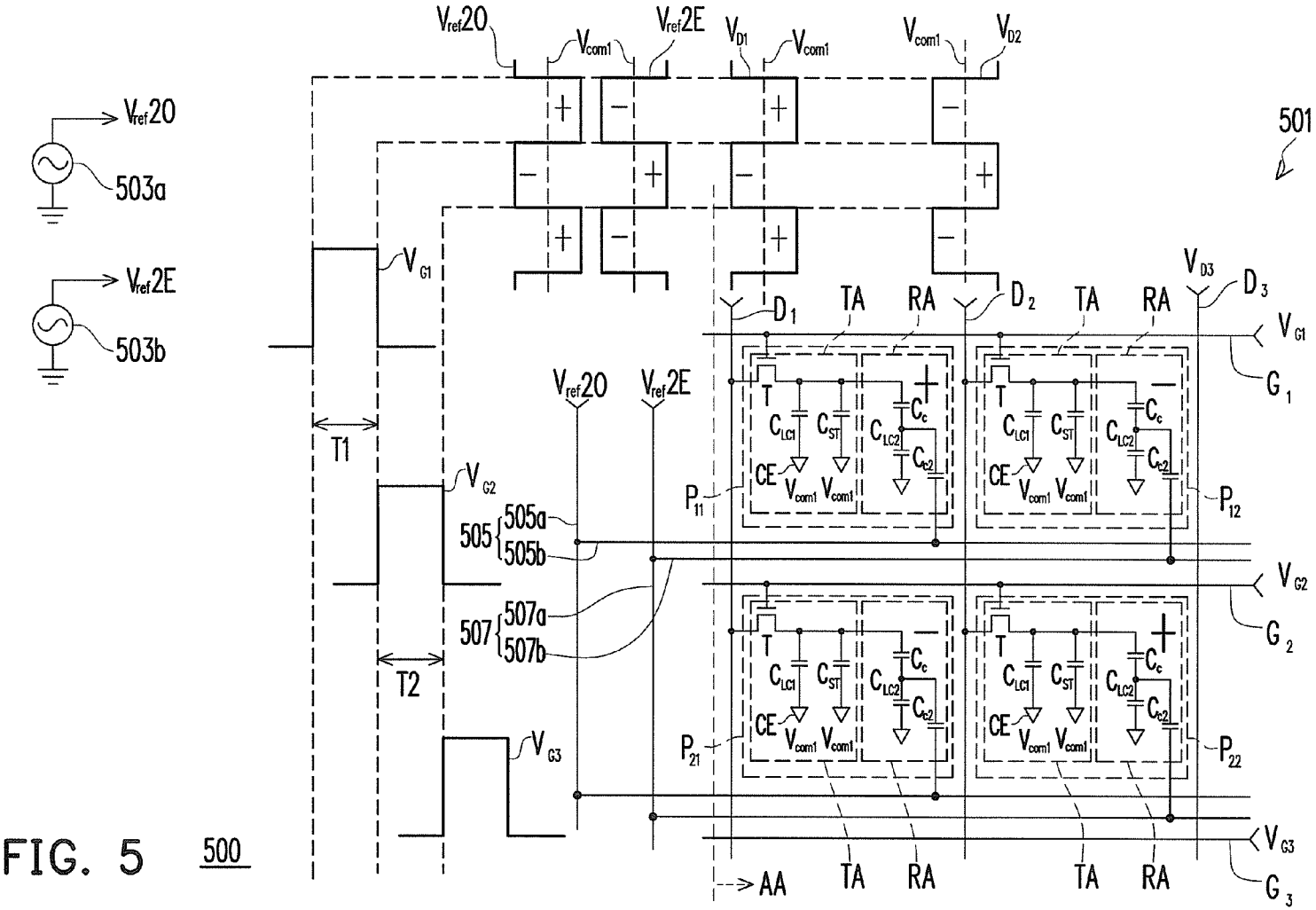
FIG. 5 is a diagram of a TR LCD with single cell gap mode according to an exemplary embodiment of the present invention.

FIG. 5 is a diagram of a TR LCD 500 with single cell gap mode according to an exemplary embodiment of the present invention. Referring to FIG. 5, the TR LCD 500 with single cell gap mode includes a display panel 501, a first reference voltage signal source 503*a*, a second reference voltage signal source 503*b* and two reference voltage lines 505 and 507. For simplicity, the display panel 501 herein includes three scan lines $G_1$-$G_3$, three data lines $D_1$-$D_3$ disposed substantially perpendicularly to the scan lines $G_1$-$G_3$ and four pixels $P_{11}$, $P_{12}$, $P_{21}$ and $P_{22}$ arranged in an array and located in an active display area AA only, which the present invention is not limited to.

The reference voltage line 505 can, but not limited to, include a first total reference voltage line 505*a* disposed outside the active display area AA of the display panel 501 and a plurality of first sub reference voltage lines 505*b* mainly distributed in the active display area AA of the display panel 501. In addition, the reference voltage line 507 can also, but not limited to, include a second total reference voltage line 507*a* disposed outside the active display area AA of the display panel 501 and a plurality of second sub reference voltage lines 507*b* mainly distributed in the active display area AA of the display panel 501.

In this exemplary embodiment, the pixels $P_{11}$, $P_{12}$, $P_{21}$ and $P_{22}$ are respectively coupled to a corresponding scan line and a corresponding data line. For example, the pixel $P_{11}$ is coupled to the scan line $G_1$ and the data line $D_1$; the pixel $P_{12}$ is coupled to the scan line $G_1$ and the data line $D_2$; the pixel $P_{21}$ is coupled to the scan line $G_2$ and the data line $D_1$; the pixel $P_{22}$ is coupled to the scan line $G_2$ and the data line $D_2$. The pixel $P_{11}$ herein represents the first pixel in the first row of pixels in the display panel 501; the pixel $P_{12}$ represents the second pixel in the first row of pixels in the display panel 501; the pixel $P_{21}$ herein represents the first pixel in the second row of pixels in the display panel 501; the pixel $P_{22}$ herein represents the second pixel in the second row of pixels in the display panel 501.

Each of the pixels $P_{11}$, $P_{12}$, $P_{21}$ and $P_{22}$ has a transparent area TA and a reflection area RA. The transparent area TA of each of the pixels $P_{11}$, $P_{12}$, $P_{21}$ and $P_{22}$ has a pixel transistor T, a first liquid crystal capacitor $C_{LC1}$ and a storage capacitor $C_{ST}$, all of which are disposed in TA; the reflection area RA of each of the pixels $P_{11}$, $P_{12}$, $P_{21}$ and $P_{22}$ has a coupling capacitor $C_C$, a second liquid crystal capacitor $C_{LC2}$ and a compensation capacitor $C_{C2}$, all of which are disposed in RA.

The gates of the two pixel transistors T of the pixels $P_{11}$ and $P_{21}$ are respectively coupled to the scan lines $G_1$ and $G_2$, and the sources of the two pixel transistors T of the pixels $P_{11}$ and $P_{21}$ are coupled to the data line $D_1$. The first terminals of the two first liquid crystal capacitors $C_{LC1}$ of the pixels $P_{11}$ and $P_{21}$ are coupled to the drains of the pixel transistors T, and the second terminals of the two first liquid crystal capacitors $C_{LC1}$ of the pixels $P_{11}$ and $P_{21}$ are coupled to the common electrode CE so as to receive a common voltage Vcom1. The first terminals of the two storage capacitors $C_{ST}$ of the pixels $P_{11}$ and $P_{21}$ are coupled to the drains of the pixel transistors T, and the second terminals of the two storage capacitors $C_{ST}$ of the pixels $P_{11}$ and $P_{21}$ are coupled to the common electrode CE.

The first terminals of the two coupling capacitors $C_C$ of the pixels $P_{11}$ and $P_{21}$ are coupled to the drains of the pixel transistors T, and the first terminals of the two second liquid crystal capacitors $C_{LC2}$ of the pixels $P_{11}$ and $P_{21}$ are coupled to the second terminals of the two coupling capacitors $C_C$. The second terminals of the two second liquid crystal capacitors $C_{LC2}$ of the pixels $P_{11}$ and $P_{21}$ are coupled to the common electrode CE, the first terminals of the two compensation capacitors $C_{C2}$ of the pixels $P_{11}$ and $P_{21}$ are coupled to the second terminals of the two coupling capacitors $C_C$, and the second terminals of the two compensation capacitors $C_{C2}$ of the pixels $P_{11}$ and $P_{21}$ pixels are coupled to the first total reference voltage line 505*a* respectively through a first sub reference voltage line 505*b*, wherein the reference voltage line 505 is respectively coupled to the reflection area of each of the odd pixels of each row of pixels in the display panel 501.

The gates of the two pixel transistors T of the pixels $P_{12}$ and $P_{22}$ are respectively coupled to the scan lines $G_1$ and $G_2$, and the sources of the two pixel transistors T of the pixels $P_{12}$ and $P_{22}$ are coupled to the data line $D_2$. The first terminals of the two first liquid crystal capacitors $C_{LC1}$ of the pixels $P_{12}$ and $P_{22}$ are coupled to the drains of the pixel transistors T, and the second terminals of the two first liquid crystal capacitors $C_{LC1}$ of the pixels $P_{12}$ and $P_{22}$ are coupled to the common electrode CE so as to receive the common voltage Vcom1. The first terminals of the two storage capacitors $C_{ST}$ of the pixels $P_{12}$ and $P_{22}$ are coupled to the drains of the pixel transistors T, and the second terminals of the two storage capacitors $C_{ST}$ of the pixels $P_{12}$ and $P_{22}$ are coupled to the common electrode CE.

The first terminals of the two coupling capacitors $C_C$ of the pixels $P_{12}$ and $P_{22}$ are coupled to the drains of the pixel transistors T, and the first terminals of the two second liquid crystal capacitors $C_{LC2}$ of the pixels $P_{12}$ and $P_{22}$ are coupled to the second terminals of the two coupling capacitors $C_C$. The second terminals of the two second liquid crystal capacitors $C_{LC2}$ of the pixels $P_{12}$ and $P_{22}$ are coupled to the common electrode CE, the first terminals of the two compensation capacitors $C_{C2}$ of the pixels $P_{12}$ and $P_{22}$ are coupled to the second terminals of the two coupling capacitors $C_C$, and the second terminals of the two compensation capacitors $C_{C2}$ of the pixels $P_{12}$ and $P_{22}$ pixels are coupled to the second total reference voltage line 507*a* respectively through a second sub reference voltage line 507*b*, wherein the reference voltage line 507 is respectively coupled to the reflection area of each of the even pixels of each row of pixels in the display panel 501.

The first reference voltage signal source 503*a* and the second reference voltage signal source 503*b* are respectively coupled to the reference voltage line 505 and the reference voltage line 507 for providing a reference voltage signal Vref2O and a reference voltage signal Vref2E. The first reference voltage signal source 503*a* and the second reference voltage signal source 503*b* herein are preferably, directly and electrically connected to the reference voltage lines 505 and 507, respectively, which means the electrical connections are not implemented through any switch component therebetween. The reference voltage signal Vref2O and the reference voltage signal Vref2E herein can be periodic/time-varying signal, and the phase-difference between Vref2O and Vref2E is 180°. The enabling duration (corresponding to a high-level signal) and the disabling duration (corresponding to a low-level signal) of the reference voltage signal Vref2O and the reference voltage signal Vref2E are respectively synchronic with or in the same period as the data voltages (for example, $V_{D1}$ and $V_{D2}$) provided by a source driver (not shown), that is to say, the reference voltage signals Vref2O and Vref2E and the data voltages have the same period or the same frequency, wherein the polarities of the reference voltage signal Vref2O and the data voltages ($V_{D1}, V_{D3}, V_{D5} \ldots$) of the odd data lines relative to the common voltage Vcom1 are the same, and the polarities are termed as, for example, the first polarity; the polarities of the reference voltage signal Vref2E and the data voltages ($V_{D2}, V_{D4}, V_{D6} \ldots$) of the even data lines relative to the common voltage Vcom1 are the same, and the polarities are termed as, for example, the second polarity. The first polarity is opposite to the second polarity. In more details, during the enabling duration (corresponding to a high-level signal) of the scan line $G_1$, the polarities of the reference voltage signal Vref2O and the data voltage $V_{D1}$ relative to the common voltage Vcom1 are positive, while the polarities of the reference voltage signal Vref2E and the data voltage $V_{D2}$ relative to the common voltage Vcom1 are negative, and analogically for the enabling duration of the rest scan lines.

The first total reference voltage line 505*a* and the second total reference voltage line 507*a* are disposed substantially parallel to the data lines $D_1$-$D_3$ (but not limited to) and located outside the active display area AA of the display panel 501. The first total reference voltage line 505*a* and the second total reference voltage line 507*a* are respectively used for receiving the reference voltage signal Vref2O and the reference voltage signal Vref2E.

In the exemplary embodiment, when the scan line $G_1$ receives the scan signal $V_{G1}$ produced by a gate driver (not shown), and for example, when the scan line $G_1$ receives an enabled scan signal $V_{G1}$ (in a high level) during the enabling duration T1, the pixel transistors T of the pixels $P_{11}$ and $P_{12}$ are started. At the time, for the display panel 501 driven by using the dot inversion panel-driving approach, the source driver must write the data voltage $V_{D1}$ in positive polarity into the pixel $P_{11}$ and the data voltage $V_{D2}$ in negative polarity into the pixel $P_{12}$. Accordingly at the time, the first reference voltage signal source 503*a* must produce a reference voltage signal Vref2O greater than the common voltage Vcom1 provided to the first total reference voltage line 505*a* (i.e., the reference voltage signal Vref2O has positive polarity relative to the common voltage Vcom1), and the second reference voltage signal source 503*b* must produce a reference voltage signal Vref2E less than the common voltage Vcom1 provided to the second total reference voltage line 507*a* (i.e., the reference voltage signal Vref2E has negative polarity relative to the common voltage Vcom1).

After that, when the scan line $G_2$ receives the scan signal $V_{G2}$ produced by the gate driver, and for example, when the scan line $G_2$ receives an enabled scan signal $V_{G2}$ (in a high level) during the enabling duration T2, the pixel transistors T of the pixels $P_{21}$ and $P_{22}$ are started. At the time, for the display panel 501 driven by using the dot inversion panel-driving approach, the source driver must write the data voltage $V_{D1}$ in negative polarity into the pixel $P_{21}$ and the data voltage $V_{D2}$ in positive polarity into the pixel $P_{22}$. Accordingly at the time, the first reference voltage signal source 503*a* must produce a reference voltage signal Vref2O less than the common voltage Vcom1 provided to the first total reference voltage line 505*a*, and the second reference voltage signal source 503*b* must produce a reference voltage signal Vref2E greater than the common voltage Vcom1 provided to the second total reference voltage line 507*b*, so that the frame polarities of the pixels $P_{11}$ and $P_{22}$ are positive, and the frame polarities of the pixels $P_{12}$ and $P_{21}$ are negative. In other words, the frame polarities of any two adjacent pixels are opposite to each other so as to achieve the dot inversion panel-driving goal.

On the other hand, the first reference voltage signal source 503*a* and the second reference voltage signal source 503*b* in the exemplary embodiment are directly and electrically connected to the first total reference voltage line 505*a* and the second total reference voltage line 507*a*, respectively, and no any switch component, for example, TFT component, is used to electrically connect the above-mentioned two total reference voltage lines. Therefore, the reference voltage signals Vref2O and Vref2E provided to the compensation capacitor $C_{C2}$ in the present invention are periodic/time-varying signals, which is beneficial to solve the floating-connection problem in a conventional driving circuit. In addition, an additional compensation capacitor $C_{C2}$ coupled to the corresponding periodic reference voltage signals Vref2O and Vref2E is further respectively employed and disposed in each reflection area RA of the pixels $P_{11}$, $P_{12}$, $P_{21}$ and $P_{22}$, which is helpful to improve the inter-match between the characteristic curve of the transparent area TA and the characteristic curve of the reflection area RA of the pixels $P_{11}$, $P_{12}$, $P_{21}$ and $P_{22}$. Thereby, the transmissive displaying effect and the reflective displaying effect of the TR LCD 500 with single cell gap mode are able to simultaneously achieve the optimization.

The reflection areas RA of the odd pixels and the even pixels in the i-th row of pixels (i is a positive integer) of the display panel 501 in the exemplary embodiment are respectively coupled to the different two reference voltage lines 505 and 507 so as to receive the corresponding reference voltage signals Vref2O and Vref2E, wherein the phase-difference between the reference voltage signals Vref2O and Vref2E is 180°. The enabling duration (the corresponding signal has a high level) and the disabling duration (the corresponding signal has a low level) thereof are respectively synchronic with the data voltages $V_{D1}$ and $V_{D2}$ provided by the source driver. That is to say, the reference voltage signals Vref2O and Vref2E and the data voltages $V_{D1}$ and $V_{D2}$ have the same period or the same frequency. In addition, the reference voltage signal Vref2O and the data voltages $V_{D1}$ (the data signal of the odd data lines) relative to the common voltage Vcom1 have the same polarities, and the reference voltage signal Vref2E and the data voltages $V_{D2}$ (the data signal of the even data lines) relative to the common voltage Vcom1 have the same polarities. It should be noted that in another exemplary embodiment, the half-periods (i.e., an enabling duration or a disabling duration) of the reference voltage signals Vref2O and Vref2E and the data voltages $V_{D1}$ and $V_{D2}$ are equal to the enabling duration of a scan line (T1 or T2). Based on the depiction above, the exemplary embodiment can adopt the dot inversion panel-driving approach to drive the display panel 501 without the limitation of the prior art.

Figure 6:
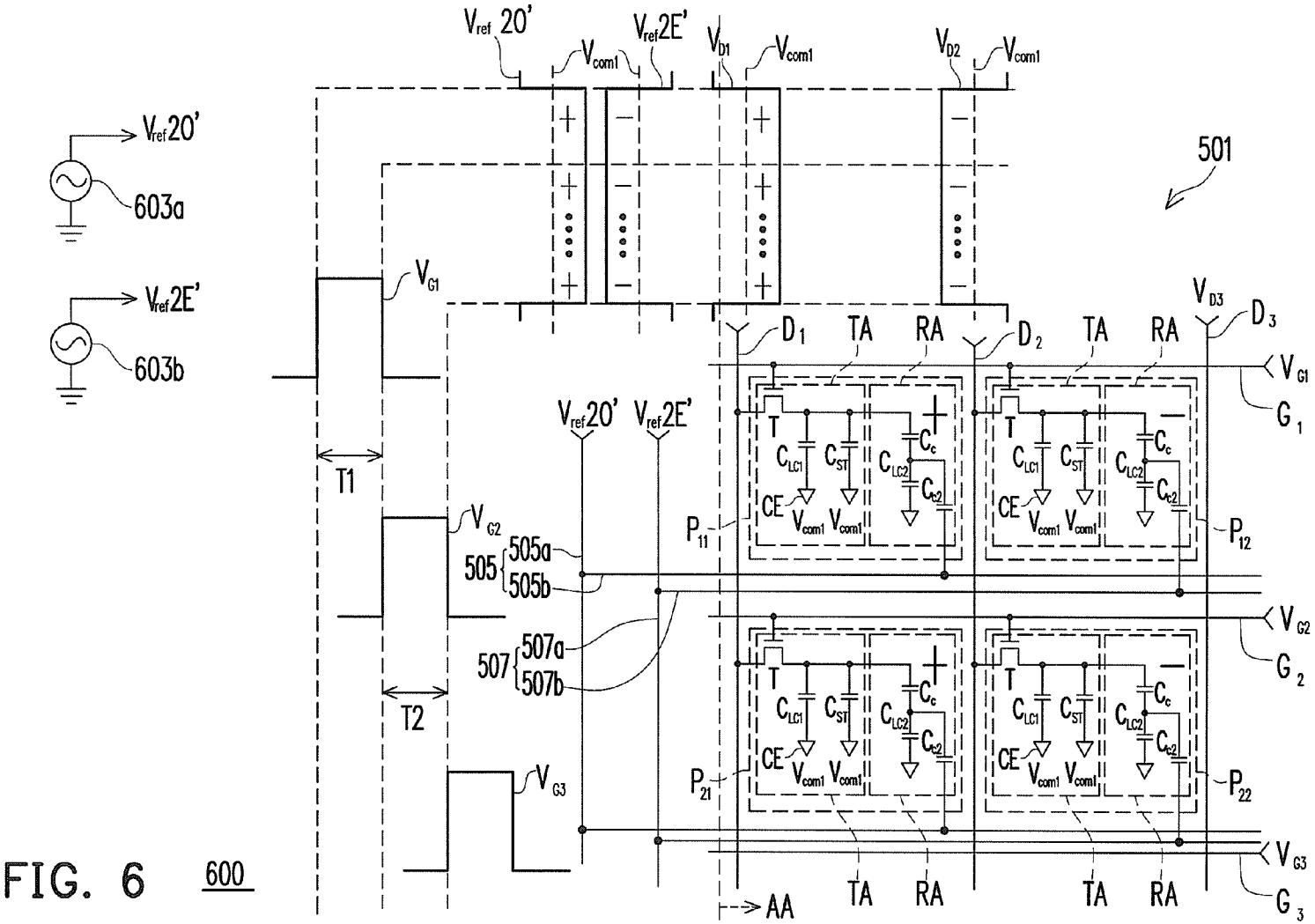
FIGS. 6-9 are diagrams of TR LCDs with single cell gap mode according to other exemplary embodiments of the present invention.

In other exemplary embodiments of the present invention, if the row inversion panel-driving approach is adopted to drive the display panel 501, the phases of the reference voltage signals Vref2O and Vref2E need to be changed into a same phase. FIG. 6 is a diagram of a TR LCD 600 with single cell gap mode according to another exemplary embodiment of the present invention. Referring to FIGS. 5 and 6, the TR LCD 600 with single cell gap mode is almost similar to the TR LCD 500 except that the periods of the signals produced by the first reference voltage signal source 603*a* and the second reference voltage signal source 603*b* are different from the periods of the signals produced by the first reference voltage signal source 503*a* and the second reference voltage signal source 503*b*.

In more details, the above-mentioned first reference voltage signal source 503*a* and the second reference voltage signal source 503*b* are used to produce the reference voltage signals Vref2O and Vref2E, between which there is a phase-difference of 180°. The reference voltage signals Vref2O and Vref2E are respectively synchronic with the data voltages $V_{D1}$ and $V_{D2}$ provided by the source driver. That is to say, the reference voltage signals Vref2O and Vref2E and the data voltages $V_{D1}$ and $V_{D2}$ have the same period or the same frequency. In addition, the reference voltage signal Vref2O and the data voltages $V_{D1}$ (the data signal of the odd data lines) relative to the common voltage Vcom1 have the same polarities (for example, positive polarity), and the reference voltage signal Vref2E and the data voltages $V_{D2}$ (the data signal of the even data lines) relative to the common voltage Vcom1 have the same polarities (for example, negative polarity). In other words, during the enabling duration T1 of the scan line $G_1$, the reference voltage signal Vref2O and the data voltages $V_{D1}$, $V_{D3}$, $V_{D5}$ . . . of the odd data lines relative to the common voltage Vcom1 have the same polarities (for example, the first polarity), and the reference voltage signal Vref2E and the data voltages $V_{D2}$, $V_{D4}$, $V_{D6}$ . . . of the even data lines relative to the common voltage Vcom1 have the same polarities (for example, the second polarity), wherein the first polarity is opposite to the second polarity. However, the enabling duration and the disabling duration of the reference voltage signals Vref2O' and Vref2E' respectively produced by the first reference voltage signal source 603*a* and the second reference voltage signal source 603*b* (or the half-period of the reference voltage signals Vref2O' and Vref2E') in the embodiment are equal to a frame period of the TR LCD 600 with single cell gap mode, wherein the reference voltage signals Vref2O' and Vref2E' are preferably periodic/time-varying signals.

Based on the above-mentioned situation, when the scan line $G_1$ receives the scan signal $V_{G1}$ produced by a gate driver (not shown), and for example, when the scan line $G_1$ receives an enabled scan signal $V_{G1}$ during the enabling duration T1, the pixel transistors T of the pixels $P_{11}$ and $P_{12}$ are started. At the time, for the display panel 501 driven by using the column inversion panel-driving approach, the source driver must write the data voltage $V_{D1}$ in positive polarity into the pixel $P_{11}$ and the data voltage $V_{D2}$ in negative polarity into the pixel $P_{12}$. Accordingly at the time, the first reference voltage signal source 603*a* must produce a reference voltage signal Vref2O' greater than the common voltage Vcom1 provided to the first total reference voltage line 505*a*, and the second reference voltage signal source 603*b* must produce a reference voltage signal Vref2E' less than the common voltage Vcom1 provided to the second total reference voltage line 507*a*.

Then, when the scan line $G_2$ receives the scan signal $V_{G2}$ produced by the gate driver, and for example, when the scan line $G_2$ receives an enabled scan signal $V_{G2}$ during the enabling duration T2, the pixel transistors T of the pixels $P_{21}$ and $P_{22}$ are started. At the time, for the display panel 501 driven by using the column inversion panel-driving approach, the source driver must write the data voltage $V_{D1}$ in positive polarity into the pixel $P_{21}$ and the data voltage $V_{D2}$ in negative polarity into the pixel $P_{22}$. Accordingly at the time, the first reference voltage signal source 603*a* must produce a reference voltage signal Vref2O' greater than the common voltage Vcom1 provided to the first total reference voltage line 505*a*, and the second reference voltage signal source 603*b* must produce a reference voltage signal Vref2E less than the common voltage Vcom1 provided to the second total reference voltage line 507*a*, so that the frame polarities of the pixels $P_{11}$ and $P_{21}$ are positive and the frame polarities of the pixels $P_{12}$ and $P_{22}$ are negative to achieve inversion driving.

On the other hand, the reference voltage signals Vref2O' and Vref2E' provided to the compensation capacitor $C_{C2}$ in the embodiment are periodic/time-varying signals, which is beneficial to solve the floating-connection problem in a conventional driving circuit. In addition, an additional compensation capacitor $C_{C2}$ coupled to the corresponding periodic reference voltage signals Vref2O' and Vref2E' is further respectively employed and disposed in each reflection area RA of the pixels $P_{11}$, $P_{12}$, $P_{21}$ and $P_{22}$, which is helpful to improve the inter-match between the characteristic curve of the transparent area TA and the characteristic curve of the reflection area RA of the pixels $P_{11}$, $P_{12}$, $P_{21}$ and $P_{22}$. Thereby, the transmissive displaying effect and the reflective displaying effect of the TR LCD 500 with single cell gap mode are able to simultaneously achieve the optimization.

The reflection areas RA of the odd pixels and the even pixels in the i-th row of pixels (i is a positive integer) of the display panel 501 in the exemplary embodiment are respectively coupled to the different two reference voltage lines 505 and 507 so as to receive the corresponding reference voltage signals Vref2O' and Vref2E', wherein the phase-difference between the reference voltage signals Vref2O' and Vref2E' is 180°. The enabling duration and the disabling duration thereof are equal to a frame period of the TR LCD 600 with single cell gap mode, and the reference voltage signals Vref2O' and Vref2E' are respectively synchronic with the data voltages $V_{D1}$ and $V_{D2}$. That is to say, the reference voltage signals Vref2O and Vref2E and the data voltages have the same period or the same frequency. Therefore, the exemplary embodiment can adopt the column inversion panel-driving approach to drive the display panel 501 without the limitation of the prior art.

In other exemplary embodiments of the present invention however, if the frame inversion panel-driving approach is adopted to drive the display panel 501, the phases of the reference voltage signals Vref2O' and Vref2E' need to be changed into a same phase.

Figure 7:
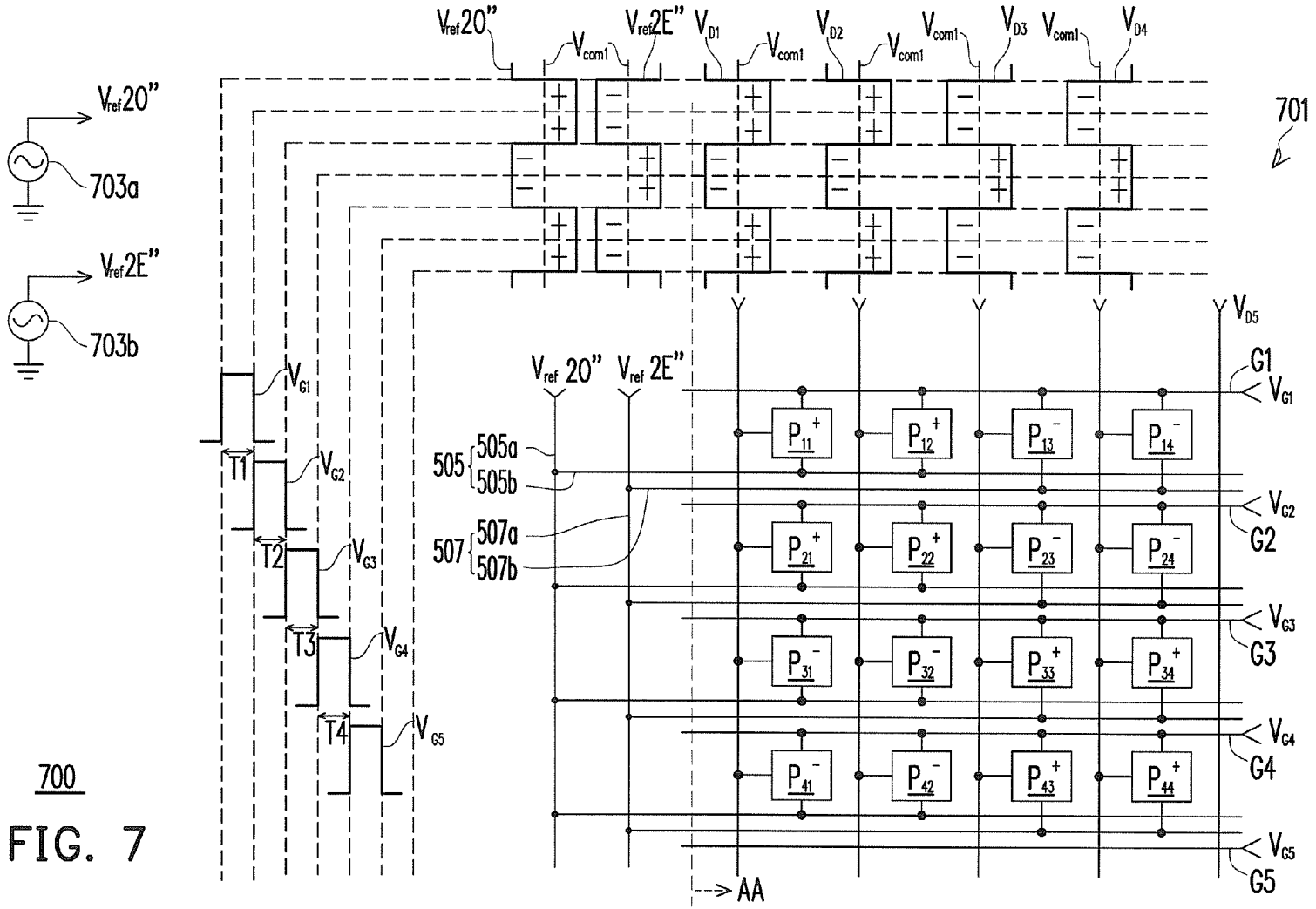

FIG. 7 is a diagram of a TR LCD 700 with single cell gap mode according to another exemplary embodiment of the present invention. Referring to FIGS. 5 and 7, the TR LCD 700 is similar to the TR LCD 500 except that the first sub reference voltage lines 505*b* of the TR LCD 700 are respectively coupled to the (4j+1)-th pixels and the (4j+2)-th pixels of each row of pixels in the display panel 701 and the second sub reference voltage lines 507*b* of the TR LCD 700 are respectively coupled to the (4j+3)-th pixels and the (4j+4)-th pixels of each row of pixels in the display panel 701, wherein j is a positive integer greater than or equal to zero.

The first reference voltage signal source 703*a* and the second reference voltage signal source 703*b* are respectively and directly coupled to the reference voltage lines 505 and 507 for producing the reference voltage signals Vref2O" and Vref2E". Preferably, the first reference voltage signal source 703*a* and the second reference voltage signal source 703*b* are respectively, directly and electrically connected to the total reference voltage lines 505*a* and 507*a* of the reference voltage lines 505 and 507, and no any switch component (for example, TFT component) is used to electrically connect the above-mentioned two total reference voltage lines. The reference voltage signal Vref2O" and the reference voltage signal Vref2E" herein can be periodic/time-varying signal, and the phase-difference between Vref2O" and Vref2E" is 180°. The reference voltage signal Vref2O" is respectively synchronic with the data voltages ($V_{D1}$, $V_{D2}$, $V_{D5}$, $V_{D6}$ . . . ) provided by the (4j+1)-th data lines and the (4j+2)-th data lines (i.e., having the same period), wherein the polarities of the reference voltage signal Vref2O" and the data voltages ($V_{D1}$, $V_{D2}$, $V_{D5}$, $V_{D6}$ . . . ) of the (4j+1)-th data lines and the (4j+2)-th data lines relative to the common voltage Vcom1 are the same, for example, they have the first polarity. The reference voltage signal Vref2E" is respectively synchronic with the data voltages ($V_{D3}$, $V_{D4}$, $V_{D7}$, $V_{D8}$ . . . ) provided by the (4j+3)-th data lines and the (4j+4)-th data lines (i.e., having the same period), wherein the polarities of the reference voltage signal Vref2E" and the data voltages ($V_{D3}$, $V_{D4}$, $V_{D7}$, $V_{D8}$ . . . ) of the (4j+3)-th data lines and the (4j+4)-th data lines relative to the common voltage Vcom1 are the same, for example, they have the second polarity and the first polarity is opposite to the second polarity. In more details, for example, during the enabling duration T1 of the scan signal $V_{G1}$, the reference voltage signal Vref2O" and the data voltages $V_{D1}$ and $V_{D2}$ provided by the source driver are synchronic with each other (i.e., having the same period or having a relation of integer multiples). Relative to the common voltage Vcom1, the polarities of the reference voltage signal Vref2O" and the data voltages $V_{D1}$ and $V_{D2}$ are positive. The reference voltage signal Vref2E" and the data voltages $V_{D1}$ and $V_{D2}$ provided by the source driver are synchronic with each other (i.e., having the same period or having a relation of integer multiples). Relative to the common voltage Vcom1, the polarities of the reference voltage signal Vref2E" and the data voltages $V_{D1}$ and $V_{D2}$ are negative.

It should be noted that in the exemplary embodiment, an enabling duration or a disabling duration (or a half-period) of the reference voltage signals Vref2O" and Vref2E" and the data voltages $V_{D1}$, $V_{D2}$, $V_{D3}$ and $V_{D4}$ is greater than the enabling duration of a scan line (for example, T1, T2 . . . ) and less than a frame period. Although in the embodiment, an enabling duration or a disabling duration of the reference voltage signals Vref2O" and Vref2E" and the data voltages $V_{D1}$, $V_{D2}$, $V_{D3}$ and $V_{D4}$ is equal to the two times of the enabling duration of a scan line, but in another embodiment, an enabling duration or a disabling duration of the reference voltage signals Vref2O" and Vref2E" and the data voltages $V_{D1}$, $V_{D2}$, $V_{D3}$ and $V_{D4}$ can be equal to a half of the frame period.

Based on the depiction above, the exemplary embodiment can adopt the two-lines two-dots inversion panel-driving approach to drive the display panel 701. Moreover, in other exemplary embodiments of the present invention, the other approaches, such as two-lines inversion panel-driving approach, two-rows inversion panel-driving approach and so on, can be adopted to drive the display panel to meet the actual design requirement through properly modifying the wiring between the display panel and the two reference voltage lines. The above-mentioned modified approaches still fall in one of the claims of the present invention.

Figure 8:
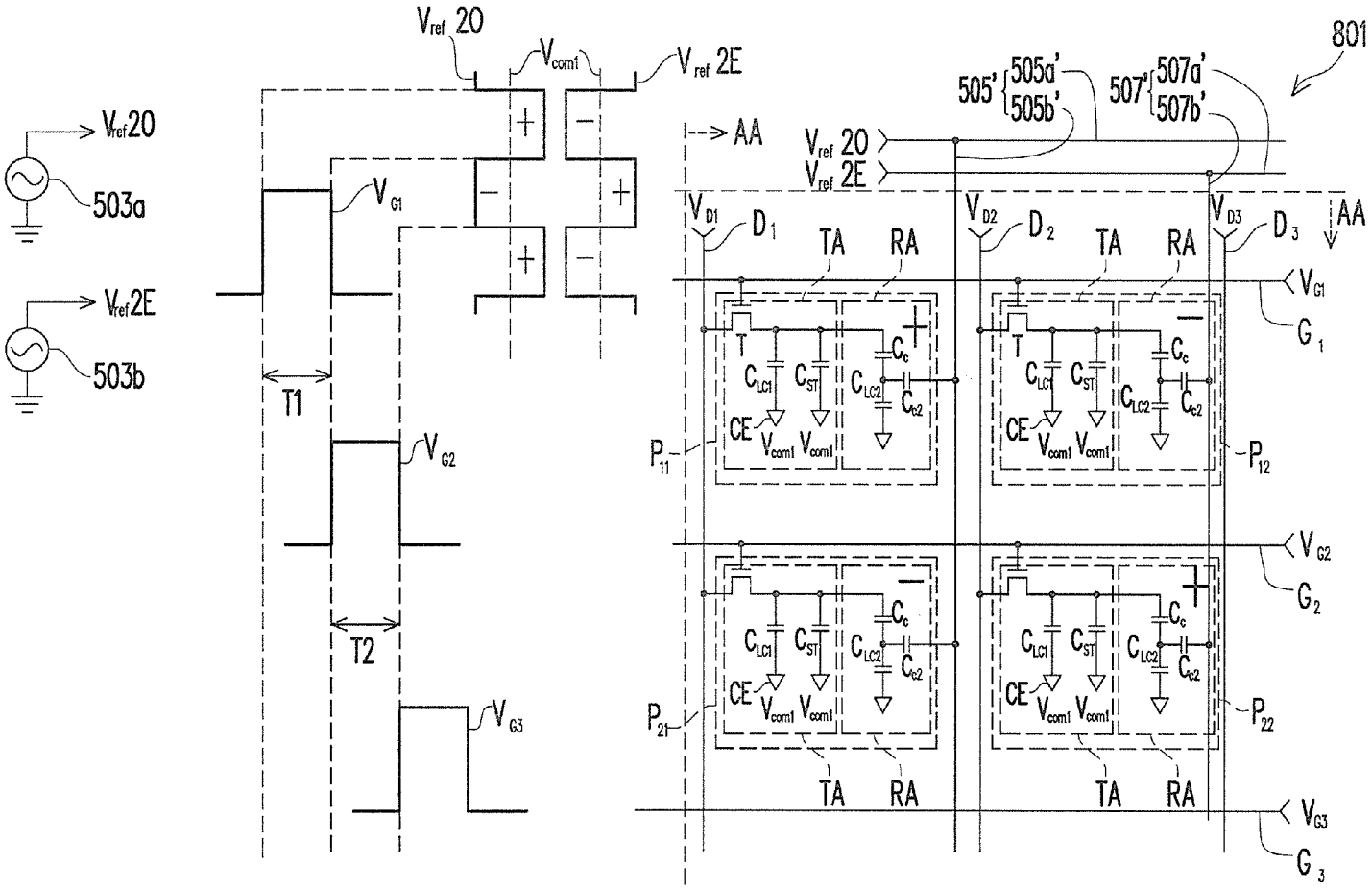

FIG. 8 is a diagram of a TR LCD 800 with single cell gap mode according to further another exemplary embodiment of the present invention. Referring to FIGS. 5 and 8, the TR LCD 800 with single cell gap mode has the same signal driving approach as the TR LCD 500 and the similar display panel to the TR LCD 500 except that the reference voltage lines in the display panel 801 have different layout from the display panel 501. In more details, in the exemplary embodiment of FIG. 5, the first total reference voltage line 505*a* and the second total reference voltage line 507*a* have substantially the same disposition direction as the data lines $D_1$-$D_3$; i.e., the first total reference voltage line 505*a*, the second total reference voltage line 507*a* and the data lines $D_1$-$D_3$ are disposed in the display panel 501 in the vertical direction. Preferably, the first total reference voltage line 505*a*, the second total reference voltage line 507*a* and the data lines $D_1$-$D_3$ are substantially parallel to each other. On the other hand, the first sub reference voltage lines 505*b* and the second sub reference voltage lines 507*b* have substantially the same disposition direction as the scan lines $G_1$-$G_3$; i.e., the first sub reference voltage lines 505*b*, the second sub reference voltage lines 507*b* and the scan lines $G_1$-$G_3$ are disposed in the display panel 501 in the horizontal direction. Preferably, the first sub reference voltage lines 505*b*, the second sub reference voltage lines 507*b* and the scan lines $G_1$-$G_3$ are substantially parallel to each other.

As a matter of fact, the first total reference voltage line 505*a*' and the second total reference voltage line 507*a*' of the exemplary embodiment of FIG. 8 have substantially the same disposition direction as the scan lines $G_1$-$G_3$; i.e., the first total reference voltage line 505*a*', the second total reference voltage line 507*a*' and the scan lines $G_1$-$G_3$ are disposed in the display panel 801 in the horizontal direction. Preferably, the first total reference voltage line 505*a*', the second total reference voltage line 507*a*' and the scan lines $G_1$-$G_3$ are substantially parallel to each other. Besides, the first sub reference voltage lines 505*b*' and the second sub reference voltage lines 507*b*' have substantially the same disposition direction as the data lines $D_1$-$D_3$; i.e., the first sub reference voltage lines 505*b*', the second sub reference voltage lines 507*b*' and the data lines $D_1$-$D_3$ are disposed in the display panel 801 in the vertical direction. Preferably, the first sub reference voltage lines 505*b*', the second sub reference voltage lines 507*b*' and the data lines $D_1$-$D_3$ are substantially parallel to each other. It should be noted that in the exemplary embodiment, the first total reference voltage line 505*a*' and the second total reference voltage line 507*a*' are located outside the active display area AA of the display panel 801.

In more details, in the exemplary embodiment of FIG. 5, a first sub reference voltage line and a second sub reference voltage line are simultaneously disposed on each row of pixels, while in the exemplary embodiment of FIG. 8, only a first sub reference voltage line is disposed on each odd column of pixels, and only a second sub reference voltage line is disposed on each even column of pixels. In other words, in the exemplary embodiment of FIG. 8, each column of pixels has one of a plurality of sub reference voltage lines only.

As a result, in the exemplary embodiment of FIG. 8, the area in each pixel occupied by the first sub reference voltage line 505*b*' and the second sub reference voltage line 507*b*' is substantially less than the area in each pixel occupied by the first sub reference voltage line 505*b* and the second sub reference voltage line 507*b* in the exemplary embodiments of FIGS. 5-7. In more details, the area in each pixel occupied by the sub reference voltage lines in the exemplary embodiment of FIG. 8 is less than the corresponding area in the exemplary embodiments of FIG. 5-7 by 50%, and in turn, the aperture ratio of each pixel in the TR LCD 800 with single cell gap mode would be greater than the aperture ratio of each pixel in the TR LCD 500 with single cell gap mode.

Although in the exemplary embodiment, the dot inversion panel-driving approach is used to drive the display panel 801, but in other exemplary embodiments of the present invention however, if the row inversion panel-driving approach is adopted to drive the display panel 801, the phases of the reference voltage signals Vref2O and Vref2E need to be changed into a same phase.

Figure 9:
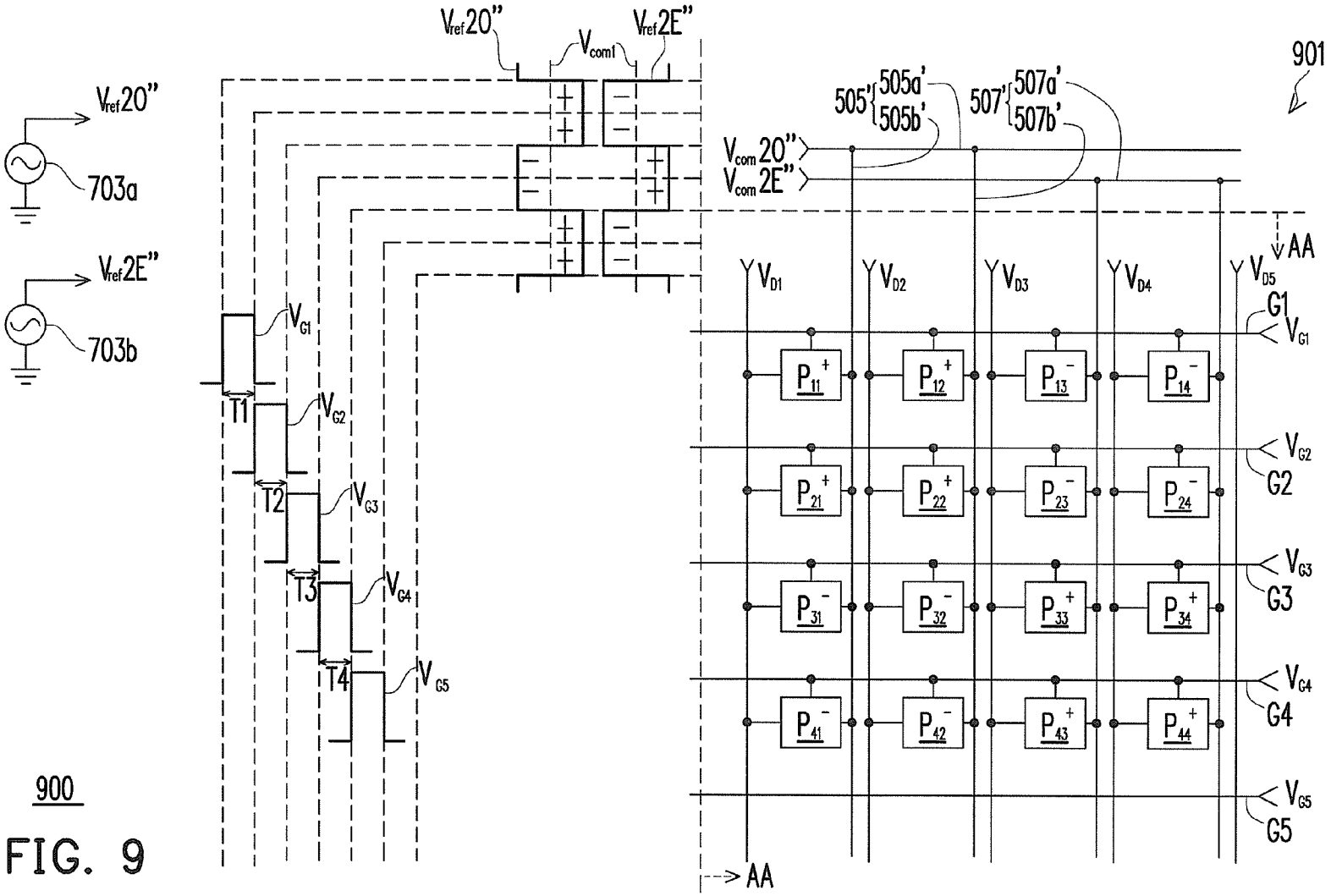

The signal driving approaches of FIGS. 6 and 7 are also suitable for the display panel with the layout of the reference voltage lines as shown by FIG. 8. For example, FIG. 9 is a diagram of a TR LCD 900 with single cell gap mode according to further another exemplary embodiment of the present invention. Referring to FIGS. 7 and 9, the TR LCD 900 with single cell gap mode is similar to the TR LCD 700 except that the reference voltage lines in the display panel 901 have different layout from the display panel 701.

The first total reference voltage line 505*a*' and the second total reference voltage line 507*a*' of the exemplary embodiment of FIG. 9 have substantially the same disposition direction as the scan lines $G_1$-$G_5$; i.e., the first total reference voltage line 505*a*', the second total reference voltage line 507*a*' and the scan lines $G_1$-$G_5$ are disposed in the display panel 901 in the horizontal direction. Preferably, the first total reference voltage line 505*a*', the second total reference voltage line 507*a*' and the scan lines $G_1$-$G_5$ are substantially parallel to each other. Besides, the first sub reference voltage lines 505*b*' and the second sub reference voltage lines 507*b*' have substantially the same disposition direction as the data lines $D_1$-$D_5$; i.e., the first sub reference voltage lines 505*b*', the second sub reference voltage lines 507*b*' and the data lines $D_1$-$D_5$ are disposed in the display panel 901 in the vertical direction. Preferably, the first sub reference voltage lines 505*b*', the second sub reference voltage lines 507*b*' and the data lines $D_1$-$D_5$ are substantially parallel to each other. It should be noted that in the exemplary embodiment, the first total reference voltage line 505*a*' and the second total reference voltage line 507*a*' are located outside the active display area AA of the display panel 901.

In more details, in the exemplary embodiment of FIG. 7, a first sub reference voltage line and a second sub reference voltage line are simultaneously disposed on each row of pixels, while in the exemplary embodiment of FIG. 9, only a first sub reference voltage line is respectively disposed on each (4j+1)-th column of pixels and on each (4j+2)-th column of pixels, and only a second sub reference voltage line is respectively disposed on each (4j+3)-th column of pixels and on each (4j+4)-th column of pixels.

As a result, in the exemplary embodiment of FIG. 9, the area in each pixel occupied by the first sub reference voltage line 505*b*' and the second sub reference voltage line 507*b*' is substantially less than the area in each pixel occupied by the first sub reference voltage line 505*b* and the second sub reference voltage line 507*b* in the exemplary embodiment of FIG. 7. In more details, the area in each pixel occupied by the sub reference voltage lines in the exemplary embodiment of FIG. 9 is less than the corresponding area in the exemplary embodiment of FIG. 7 by 50%, and in turn, the aperture ratio of each pixel in the TR LCD 900 with single cell gap mode would be greater than the aperture ratio of each pixel in the TR LCD 700 with single cell gap mode.

Based on the depiction above, the exemplary embodiment can adopt the two-lines two-dots inversion panel-driving approach to drive the display panel 901. Moreover, in other exemplary embodiments of the present invention, the other approaches, such as two-lines inversion panel-driving approach, two-rows inversion panel-driving approach and so on, can be adopted to drive the display panel to meet the actual design requirement through properly modifying the wiring between the display panel and the two reference voltage lines. The above-mentioned modified approaches still fall in one of the claims of the present invention.

In summary, in the TR LCD provided by the present invention, all pixel areas in the i-th row of pixels (i is a positive integer) of the display panel are divided into at least two pixel-groups: a first pixel-group and a second pixel-group. The first pixel-group herein comprises, for example but not limited to, all the odd pixels (as shown in FIG. 5, FIG. 6 and FIG. 8) or the (4j+1)-th and (4j+2) pixels (as shown in FIG. 7 and FIG. 9) of the i-th row of pixels, and the second pixel-group herein comprises, for example but not limited to, all the even pixels (as shown in FIG. 5, FIG. 6 and FIG. 8) or the (4j+3)-th and (4j+4) pixels (as shown in FIG. 7 and FIG. 9) of the i-th row of pixels. The reflection areas of all the pixels in the two pixel-groups are respectively coupled to different reference voltage lines so as to receive the corresponding periodic/time-varying reference voltage signals.

Preferably, the phase-difference between the reference voltage signals coupled by the two pixel-groups is 180°, and the reference voltage signals are synchronic with the data voltages or have the same period as the data voltages. More preferably, the data signals received by the corresponding first pixel-group and the reference voltage signals received by the corresponding first pixel-group have a same first polarity relative to the common voltage; the data signals received by the corresponding second pixel-group and the reference voltage signals received by the corresponding second pixel-group have a same second polarity relative to the common voltage. In general, the above-mentioned first polarity and second polarity are opposite to each other. In this way, the TR LCD provided by the present invention is advantageous not only in simultaneously achieving the optimization of the transmissive displaying effect and the reflective displaying effect, but also in adopting various panel-driving approach depending on the actual application need, such as row inversion panel-driving approach, frame inversion panel-driving approach, column inversion panel-driving approach, dot inversion panel-driving approach, two-lines two-dots inversion panel-driving approach, two-lines inversion panel-driving approach and two-rows inversion panel-driving approach, which contributes to promote the design generalization of the TR LCD.

It will be apparent to those skilled in the art that the descriptions above are several preferred embodiments of the present invention only, which does not limit the implementing range of the present invention. Various modifications and variations can be made to the structure of the present invention without departing from the scope or spirit of the invention.

What is claimed is:

1. A liquid crystal display, comprising: a display panel, comprising:

a plurality of scan lines;

a plurality of data lines, disposed substantially perpendicularly to the scan lines; and a plurality of pixels arranged in an array, respectively coupled to a corresponding data line and a corresponding scan line, wherein each pixel has a transparent area and a reflection area, and each row of pixels is divided by definition into a first pixel-group and a second pixel-group;

a first reference voltage line, only coupled to the reflection areas of the pixels of the first pixel-group of each row of pixels for receiving a first reference voltage signal, wherein the first reference voltage signal is a first time-varying or periodic reference voltage signal; and a second reference voltage line, only coupled to the reflection areas of the pixels of the second pixel-group of each row of pixels, for receiving a second reference voltage signal, wherein the second reference voltage signal is different from the first reference voltage signal and is a second time-varying or periodic reference voltage signal, wherein the reflection areas of the pixels of the first pixel-group and the reflection areas of the pixels of the second pixel group simultaneously and respectively receive the different first and second reference voltage signals, and wherein the first pixel-group comprises the odd pixels of each row of pixels and the second pixel-group comprises the even pixels of each row of pixels.

2. The liquid crystal display as claimed in claim 1, wherein the first reference voltage line comprises:

a first total reference voltage line, disposed outside an active display area of the display panel; and a plurality of first sub reference voltage lines, coupled to the first total reference voltage line and disposed substantially in the active display area of the display panel, wherein each of the first sub reference voltage lines is only coupled to the reflection areas of the first pixel-group of corresponding row of pixels.

3. The liquid crystal display as claimed in claim 2, wherein the second reference voltage line comprises:

a second total reference voltage line, disposed outside the display area of the display panel; and a plurality of second sub reference voltage lines, coupled to the second total reference voltage line and disposed substantially in the display area of the display panel, wherein each of the second sub reference voltage lines is only coupled to the reflection areas of the second pixel-group of corresponding row of pixels.

4. The liquid crystal display as claimed in claim 3, wherein the first total reference voltage line and the second total reference voltage line are substantially parallel to the data lines, and the first sub reference voltage lines and the second sub reference voltage lines are substantially parallel to the scan lines.

5. The liquid crystal display as claimed in claim 4, wherein one of the first sub reference voltage lines and one of the second sub reference voltage lines are disposed on each row of pixels.

6. The liquid crystal display as claimed in claim 4, further comprising:

a first reference voltage signal source, coupled to the first total reference voltage line for producing the first reference voltage signal; and a second reference voltage signal source, coupled to the second total reference voltage line for producing the second reference voltage signal.

7. The liquid crystal display as claimed in claim 3, wherein the first total reference voltage line and the second total reference voltage line are substantially parallel to the scan lines, and the first sub reference voltage lines and the second sub reference voltage lines are substantially parallel to the data lines.

8. The liquid crystal display as claimed in claim 7, wherein one of the first sub reference voltage lines is respectively disposed on each column of pixels where the pixels of the first pixel-group are located on and one of the second sub reference voltage lines is respectively disposed on each column of pixels where the pixels of the second pixel-group are located on.

9. The liquid crystal display as claimed in claim 7, further comprising:

a first reference voltage signal source, coupled to the first total reference voltage line for producing the first reference voltage signal; and a second reference voltage signal source, coupled to the second total reference voltage line for producing the second reference voltage signal.

10. The liquid crystal display as claimed in claim 1, wherein the phase-difference between the first reference voltage signal and the second reference voltage signal is 180°.

11. The liquid crystal display as claimed in claim 1, wherein the period of the first reference voltage signal and the period of the second reference voltage signal are the same as the period of the data signal of each data line.

12. The liquid crystal display as claimed in claim 11, wherein the enabling duration or the half-period of the first reference voltage signal and the enabling duration or the half-period of the second reference voltage signal are equal to an enabling duration of the scan signal of any one of the scan lines.

13. The liquid crystal display as claimed in claim 11, wherein the enabling duration or the half-period of the first reference voltage signal and the enabling duration or the half-period of the second reference voltage signal are equal to a frame period of the liquid crystal display.

14. The liquid crystal display as claimed in claim 1, wherein the received data signals corresponding to the first pixel-group and the first reference voltage signal have a same first polarity relative to a common voltage signal, and the received data signals corresponding to the second pixel-group and the second reference voltage signal have a same second polarity relative to the common voltage signal.

15. The liquid crystal display as claimed in claim 14, wherein the first polarity is opposite to the second polarity.

16. The liquid crystal display as claimed in claim 14, wherein the first reference voltage signal and the second reference voltage signal have the same phase and the first polarity is equal to the second polarity.

17. The liquid crystal display as claimed in claim 1, wherein the received data signals corresponding to the first pixel-group and the received data signals corresponding to the second pixel-group respectively have a polarity opposite to each other relative to a common voltage signal.

18. The liquid crystal display as claimed in claim 1, wherein the liquid crystal display is a transflective liquid crystal display with single cell gap mode.

19. The liquid crystal display as claimed in claim 1, wherein each of the transparent areas of all the pixels of the i-th row of pixels has:

a pixel transistor having a gate, a drain and a source, wherein the gate is coupled to the i-th scan line, wherein i is a positive integer;

a first liquid crystal capacitor having a first terminal and a second terminal, wherein the first terminal is coupled to the drain of the pixel transistor and the second terminal is coupled to a common electrode; and a storage capacitor having a first terminal and a second terminal, wherein the first terminal is coupled to the drain of the pixel transistor and the second terminal is coupled to the common electrode.

20. The liquid crystal display as claimed in claim 19, wherein each of the reflective areas of all the pixels of the first pixel-group of the i-th row of pixels has:

a coupling capacitor having a first terminal and a second terminal, wherein the first terminal is coupled to the drain of the pixel transistor;

a second liquid crystal capacitor having a first terminal and a second terminal, wherein the first terminal is coupled to the second terminal of the coupling capacitor and the second terminal is coupled to the common electrode; and a compensation capacitor having a first terminal and a second terminal, wherein the first terminal is coupled to the second terminal of the coupling capacitor and the second terminal is coupled to an i-th first sub reference voltage line.

21. The liquid crystal display as claimed in claim 19, wherein each of the reflective areas of all the pixels of the second pixel-group of the i-th row of pixels has:

a coupling capacitor having a first terminal and a second terminal, wherein the first terminal is coupled to the drain of the pixel transistor;

a second liquid crystal capacitor having a first terminal and a second terminal, wherein the first terminal is coupled to the second terminal of the coupling capacitor and the second terminal is coupled to the common electrode; and a compensation capacitor having a first terminal and a second terminal, wherein the first terminal is coupled to the second terminal of the coupling capacitor and the second terminal is coupled to an i-th second sub reference voltage line.

* * * * *